United States Patent [19]

Vallance et al.

[11] 4,153,530

[45] May 8, 1979

[54] DIAPHRAGM CELLS

[75] Inventors: Christopher Vallance; Peter J. Davies, both of Runcorn, England

[73] Assignee: Imperial Chemical Industries Limited, London, England

[21] Appl. No.: 888,387

[22] Filed: Mar. 20, 1978

[30] Foreign Application Priority Data

Apr. 13, 1977 [GB] United Kingdom ..... 15280/77

[51] Int. Cl.[2] ..... C25B 9/00; C25B 13/02; C25B 13/08

[52] U.S. Cl. ..... 204/252; 204/266; 204/296

[58] Field of Search ..... 204/296, 252, 253–258, 204/263–266

[56] References Cited

U.S. PATENT DOCUMENTS

| | | | |
|---|---|---|---|
| 3,923,630 | 12/1975 | Argade et al. | 204/252 X |
| 4,003,818 | 1/1977 | Juillard et al. | 204/296 |
| 4,031,041 | 6/1977 | Bouy et al. | 204/252 X |
| 4,065,534 | 12/1977 | Rechlicz et al. | 204/296 X |
| 4,081,350 | 3/1978 | K adija et al. | 204/296 |

*Primary Examiner*—John H. Mack
*Assistant Examiner*—D. R. Valentine
*Attorney, Agent, or Firm*—Cushman, Darby & Cushman

[57] ABSTRACT

An electrolytic diaphragm cell for the production of halogen, hydrogen and an alkali metal hydroxide solution by electrolysis of an aqueous alkali metal halide solution, the cell comprising a plurality of anodes vertically mounted at one side of the cell, a cathode box mounted at the opposite facing side of the cell providing cathodes between adjacent anodes, and a hydraulically permeable diaphragm between adjacent anodes and cathodes, comprising a sheet of a porous non-melt-processable fluorine-containing polymer connected to an upper and lower slotted supports of a melt-processable fluorine-containing polymer by means of strips of a melt-processable fluorine-containing polymer fused to the upper and lower edges of the diaphragm. The diaphragm preferably comprises a plurality of sheets of the non-melt-processable fluorine-containing polymer which are joined together by joining strips of melt-processable fluorine-containing polymer fused into the sheets at or near juxtaposed edges of the sheets.

8 Claims, 5 Drawing Figures

DIAPHRAGM CELLS

This invention relates to electrolytic diaphragm cells.

Porous diaphragms based on tetrafluoroethylene polymers are especially suitable for use in cells electrolysing alkali metal chloride solutions. Unfortunately, however, there are problems associated with the development of the use of such diaphragms in electrolytic cells. For example, there is generally a limit on the dimensions of the diaphragm sheets that can be produced in practice. Of necessity the width of the diaphragm sheet is governed by the size of the rolls employed in producing the sheet. The cost of increasing the size of the manufacturing equipment is exponential with the result that there is an optimum size of roll which is dependent upon purely commercial factors. Moreover, diaphragms of simple rectangular sheet form are extremely difficult to fit on to the complicated cathode designs of modern diaphragm cells because of the numerous recesses and protuberances presented by the cathode. The aforesaid problems are accentuated in the case of diaphragms made of non-melt processable materials such as polytetrafluoroethylene. The main reason for this is that it is extremely difficult to join together small sheets of polytetrafluoroethylene in order to produce a diaphragm of the desired complex shape and size.

In the specification of our UK Patent Application No. 28804/74 (Belgian Patent No. 830739) we have described a method of manufacturing a porous diaphragm for an electrolytic cell from a plurality of sheets of filled polytetrafluoroethylene which method comprises fusing a melt-processable fluorine-containing polymer into the sheets at or near juxtaposed edges of the sheets at a temperature which will not substantially decompose the filler in the sheets, solidifying the melt-processable polymer so as to effect joining of the sheets, and thereafter removing filler from the thus joined sheets to produce a porous sheet.

By the term filled polytetrafluoroethylene sheet we mean polytetrafluoroethylene sheet containing a removable solid particulate additive (e.g. starch) which may be removed from the sheet in order to impart porosity to the sheet. The resultant porous sheet may then be used as a diaphragm in an electrolytic cell.

By melt-processable fluorine-containing polymer we mean a fluorine-containing polymer, which may be fused by the application of heat and which returns to its original form on removal of heat and also retains its original properties.

In one embodiment of the invention described in the aforesaid specification two or more sheets of filled polytetrafluoroethylene are joined along juxtaposed edges by overlapping the edges with one or more strips of melt-processable fluorine-containing polymer and fusing the strip or strips into the areas of the sheets adjacent to the juxtaposed edges.

However, in a preferred embodiment of the aforesaid invention one or more strips of melt-processable fluorine-containing polymer can be made to partially overlap one or more edges of a sheet of filled polytetrafluoroethylene and protruding portions of the strip or strips can be utilised as desired to bond the polytetrafluoroethylene sheet to other polytetrafluoroethylene sheets which have not had melt-processable strips of fluorine-containing polymer fused thereto. Conveniently all four sides of a rectangular sheet of filled polytetrafluoroethylene can be provided with overlapping strips of melt-processable fluorine-containing polymer to give a window-frame of melt-processable polymer which can be joined to other filled polytetrafluoroethylene sheets by conventional plastics fabrication techniques.

We have now found that the method of joining polytetrafluoroethylene sheets as described in the aforesaid UK Application No. 28804/74 may be adapted for providing an improved method for supporting the diaphragms in an electrolytic cell.

According to the present invention we provide an electrolytic diaphragm cell for the production of halogen, hydrogen and an alkali metal hydroxide solution by electrolysis of an aqueous alkali metal halide solution, which cell comprises a plurality of vertical anodes vertically providing at least one side of the cell, a cathode box providing at least the opposite facing side of the cell and providing a cathode between adjacent anodes, and a hydraulically permeable diaphragm between adjacent anodes and cathodes, wherein the diaphragm comprises a sheet of a porous non-melt processable fluorine-containing polymer connected to upper and lower slotted supports of a melt-processable fluorine-containing polymer by means of strips of a melt-processable fluorine-containing polymer fused to the upper and lower edges of the diaphragm, and wherein the supports are located in the cell so that the slots in the upper and lower supports are in vertical alignment with one another and the anodes extend into the space defined by the upper and lower supports and the diaphragms.

The diaphragm may be in the form of a single sheet of the non-melt processable fluorine-containing polymer, but in commercial cells, the diaphragm conveniently comprises a plurality of sheets of the non-melt processable fluorine-containing polymer which are joined together by a strip or strips of melt-processable fluorine-containing polymer fused into the sheets at a near juxtaposed edges of the sheets. The joining of adjacent sheets by means of the aforesaid strip or strips may be carried out using conventional plastics fabrication techniques, such as hot-pressing.

The non-melt-processable fluorine-containing polymer comprising the diaphragm may be of polyvinylidene fluoride, for example, but the preferred polymer is polytetrafluoroethylene.

The sheet or sheets of non-melt-processable fluorine-containing polymer constituting the diaphragm may be derived from filled polytetrafluoroethylene (i.e. polytetrafluoroethylene containing a removable filler such as starch). The filled sheets may, be prepared from aqueous dispersions of polytetrafluoroethylene and removable filler by the methods described in our UK Patents Nos. 1081046 and 1424804. The filler may be removed prior to introducing the diaphragm into the cell, for example by treatment with acid to dissolve the filler. Alternatively the filler may be removed from the diaphragm in situ in the cell, for example as described in the specification of our copending UK Patent Application No. 1468355 in which either acid containing a corrosion inhibitor is used to dissolve the filler or the filler is removed electrolytically.

Alternatively the diaphragm may be formed from one or more sheets of porous polymeric material containing units derived from tetrafluoroethylene, said material having a microstructure characterised by nodes interconnected by fibrils. The aforesaid polymeric material and its preparation are described in UK Patent No. 1355373, and its use as a diaphragm in electrochemical cells is described in our copending cognate UK Patent Application Nos. 23275/74 and 23316/74 (Belgian Patent No. 829388).

The sheet or sheets constituting the diaphragm may also be formed by an electrostatic spinning process. Such a process is described in our copending UK Patent Application No. 41873/74 (Belgian Patent No. 833912) and involves introducing a spinning liquid comprising an organic fibre forming polymeric material (e.g. a fluorine-containing polymer such as polytetrafluoroethylene) into an electric field whereby fibres are drawn from the liquid to an electrode and collecting the fibres so produced upon the electrode in the form of a porous sheet product or mat.

The porous diaphragm may contain a non-removable filler such as titanium dioxide in order to render the diaphragm wettable when installed in an electrolytic cell.

The supports are preferably fabricated from a flexible sheet of melt-processable fluorine-containing polymer from which slots can be pressed out by any conventional method e.g. by vacuum pressing. The supports are preferably provided with slots which are open at one end, and are conveniently formed with folds along the inside edges of the slots to facilitate connection between the supports and the strips of melt-processable fluorine-containing fused to the upper and lower edges of the diaphragm. The supports and the strips of fluorine-containing polymer fused to the diaphragm may conveniently be joined using conventional plastics fabrication techniques, for example by means of hot-pressing or the application of a suitable cement (for example a low melting point fluoropolymer).

The melt-processable fluorine-containing polymer used in fabrication of the diaphragm and used for fabricating the upper and lower slotted supports is preferably selected from polychlorotrifluoroethylene, polyvinylidene fluoride, fluorinated ethylene/propylene copolymer, a copolymer of tetrafluoroethylene and polyperfluoroalkoxy compounds, or a copolymer of ethylene and chlorotrifluoroethylene. It is especially preferred to use a fluorinated ethylene/propylene copolymer as the melt-processable fluorine-containing polymer.

The anodes preferably comprise film-forming metal plates carrying on at least part of their surface an electrocatalytically active coating.

In this specification, by a 'film-forming metal' we mean one of the metals titanium, zirconium, niobium, tantalum or tungsten or an alloy consisting principally of one of these metals and having anodic polarisation properties which are comparable to those of the pure metal. It is preferred to use titanium alone, or an alloy based on titanium and having polarisation properties comparable to those of titanium, as the film-forming metal constituting the anode plate. Examples of such alloys are titanium-zirconium alloys containing up to 14% of zirconium, alloys of titanium with up to 5% of a platinum group metal, e.g. platinum, rhodium or iridium, and alloys of titanium with niobium or tantalum containing up to 10% of the alloying constituent.

The anodes are mounted on a sidewall comprising a metal plate, preferably of a film-forming metal, e.g. titanium, and the plate comprising the sidewall is in turn conductively bonded a suitable conductor, e.g. to a mild steel slab, which serves as a conductor providing a low-resistance electrical flow path between the anodes and copper conductors attached to the mild steel slab.

The electrocatalytically active coating is a conductive coating which is resistant to electrochemical attack but is active in transferring electrons between electrolyte and the anode.

The electrocatalytically active coating may suitably consist of one or more platinum group metals, i.e. platinum, rhodium, iridium, ruthenium, osmium and palladium, or alloys of the said metals, and/or the oxides thereof, or another metal or a compound which will function as an anode and which is resistant to electrochemical dissolution in the cell, for instance rhenium, rhenium trioxide, magnetite, titanium nitride and the borides phosphides and silicides of the platinum group metals. The coating may consist of one or more of the said platinum group metals and/or oxides thereof in admixture with one or more non-noble metal oxides. Alternatively, it may consist of one or more non-noble metal oxides alone or a mixture of one or more non-noble metal oxides and a non-noble metal chlorine discharge catalyst. Suitable non-noble metal oxides are, for example, oxides of the film-forming metals (titanium, zirconium, niobium, tantalum, or tungsten), tin dioxide, germanium dioxide and oxides of antimony. Suitable chlorine-discharge catalysts include the difluorides of manganese, iron, cobalt, nickel and mixtures thereof.

Especially suitable electrocatalytically active coatings include platinum itself and those based on ruthenium dioxide/titanium oxide and ruthenium dioxide/tin dioxide/titanium dioxide.

Other suitable coatings include those described in our UK Patents Nos. 1402414 and 1484015 in which a non-conductive particulate or fibrous refractory material is embedded in a matrix of electrocatalytically active material (of the type described above). Suitable non-conducting particulate or fibrous materials include oxides, carbides, fluorides, nitrides and sulphides. Suitable oxides (including complex oxides) include zirconia, alumina, silica, thorium oxide, titanium dioxide, ceric oxide, hafnium oxide, ditantalum pentoxide, magnesium aluminate (e.g. spinel $MgO.Al_2O_3$), aluminosilicates (e.g. mullite $(Al_2O_3)(SiO_2)_2$), zirconium silicate, glass, calcium silicate (e.g. bellite $(CaO)_2SiO_2$), calcium aluminate, calcium titanate (e.g. perovskite $CaTiO_3$), attapulgite, kaolinite, asbestos, mica, codierite and bentonite; suitable sulphides include dicerium trisulphide, suitable nitrides include boron nitride and silicon nitride; and suitable fluorides include calcium fluoride. A preferred non-conducting refractory material is a mixture of zirconium silicate and zirconia, for example zirconium silicate particles and zirconia fibres.

The anodes may be prepared by a painting and firing technique, wherein a coating of metal and/or metal oxide is formed on the anode surface by applying a layer of a paint composition comprising thermally-decomposable compounds of each of the metals that are to feature in the finish coating in a liquid vehicle to the surface of the anode, and then firing the paint layer by heating the coated anode, suitably at 250° C. to 800° C., to decompose the metal compounds of the patent and form the desired coating. When refractory particles or fibres are to be embedded in the metal and/or metal oxide of the coating, the refractory particles or fibres may be mixed into the aforesaid paint composition before it is applied to the anode. Alternatively, the refractory particles or fibres may be applied on to a layer of the aforesaid paint composition while this is still in the fluid state on the surface of the anode, the paint layer then being dried by evaporation of the liquid vehicle and fired in the usual manner.

The electrode coatings are preferably built up by applying a plurality of paint layers on the anode, each layer being dried and fired before applying the next layer.

The cathodes preferably comprise mild steel or iron mesh, and are mounted in the cathode box, which is typically of mild steel. The cathode box is provided with openings into which the anodes project. The cathode box is suitably provided with a current-outlet lead, an outlet for alkali metal hydroxide solution and an outlet for hydrogen.

The cell is suitably provided with a lid, for example of mild steel, carrying an inlet for aqueous alkali metal halide solution and an outlet for halogen.

The invention is especially applicable to diaphragm cells used for the manufacture of chlorine and caustic soda by the electrolysis of aqueous sodium chloride solutions.

By way of example, embodiments of the present invention will now be described with reference to the accompanying drawings in which FIG. 1 is a plan schematic view of a sheet diaphragm comprising four "window-frame" sheets.

Figure 1:
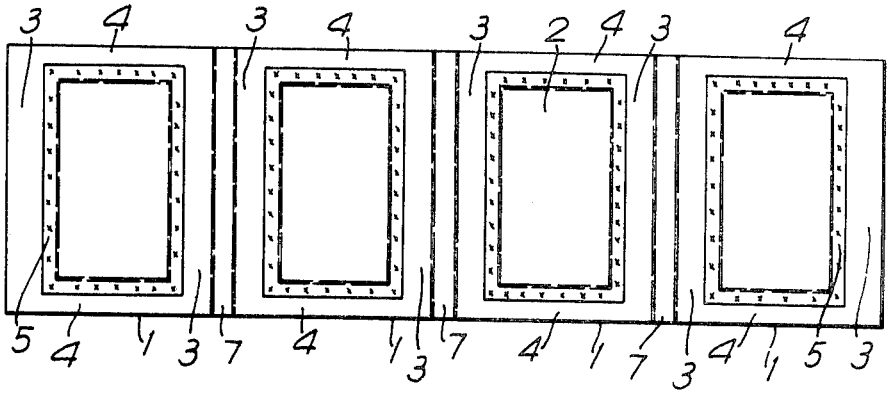

Referring initially to FIG. 1, each "window-frame" sheet 1 of the diaphragm comprises a rectangular sheet 2 of a non-melt-processable fluorine-containing polymer, for example polytetrafluoroethylene, which is either porous or contains a removable filler (for example starch) which is subsequently removed to provide the desired porosity. Each sheet 2 is provided with strips 3, 4 of a melt-processable fluorine-containing polymer, for example a fluorinated ethylene/propylene copolymer, which have been fused into the sheet 1, for example by hot pressing, to give an overlapping joint 5.

Figure 2:
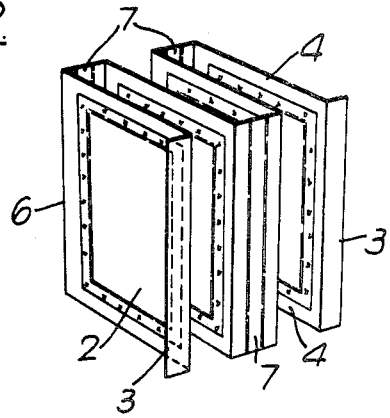
FIG. 2 is a perspective schematic view of the sheet diaphragm of FIG. 1 showing the shape adopted in a cell.

The diaphragm 6 shown in FIG. 1 and FIG. 2 comprises four "window-frame" sheets 1. It is formed by joining pairs of strips 3 to give overlapping joints at 7, for example by hot-pressing to give welded joints or by the application of a suitable cement (e.g. a low molecular weight, low melting point polytetrafluoroethylene). The diaphragm 6 thus obtained has continuous strips 4 of a melt-processable fluorine-containing polymer along its upper and lower edges respectively, and strips 3 at each end. When in position in a cell, diaphragm 6 adopts the shape as shown in FIG. 2.

Figure 3:
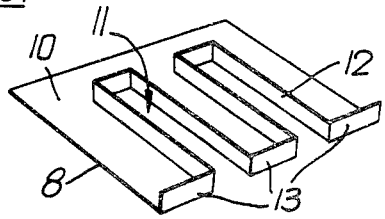
FIG. 3 is a perspective view of a support.

The upper and lower supports 8, 9 (both shown in FIG. 5; the upper support 8 is shown in FIG. 3), which are identical in shape, each comprises a sheet 10 provided with slots 11 formed by folding sections of the sheet to provide edges 12 along the perimeter of the slots 11 and edges 13 along one side of the sheet 10. When installed in a cell (FIG. 5), the upper and lower supports 8, 9 have their edges 12, 13 facing upwardly and downwardly respectively relative to sheet 10. The supports 8, 9 are comprised of a melt-processable fluorine-containing polymer, for example a fluorinated ethylene/propylene copolymer and are conveniently formed from a sheet of the aforesaid fluorine-containing polymer, for example by vacuum pressing.

Figure 4:
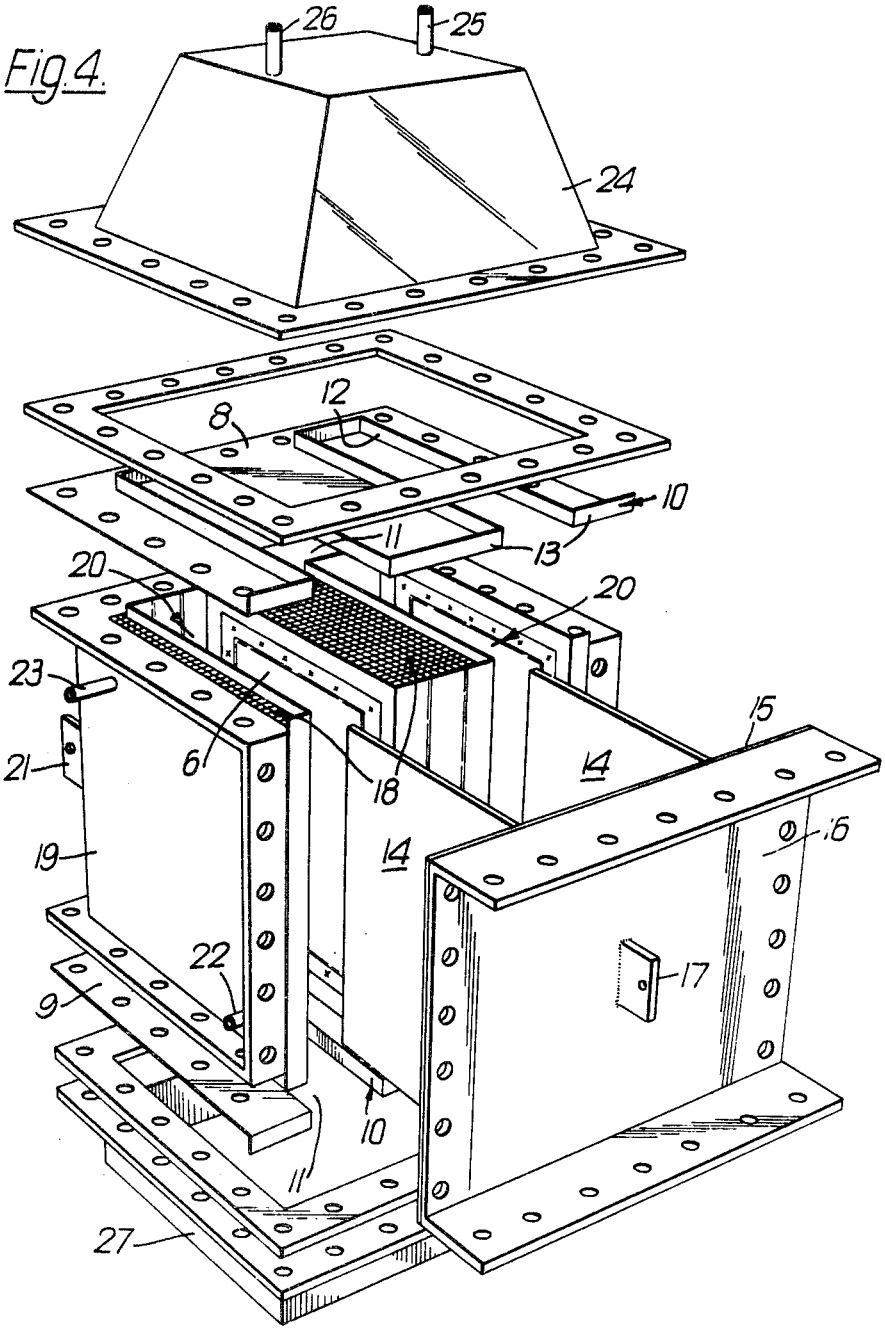
FIG. 4 is a perspective expanded view of a diaphragm cell incorporating the sheet diaphragm of FIG. 1 or FIG. 2.
Figure 5:
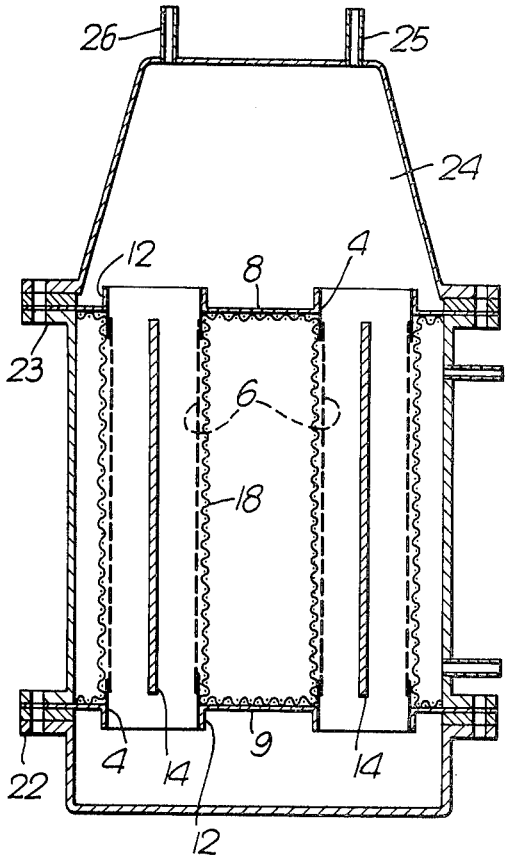
FIG. 5 is a cross sectional schematic view of the diaphragm cell of FIG. 4 and further incorporating the supports of FIG. 3.

The diaphragm cell into which the diaphragms 6 and the supports 8, 9 are to be assembled is shown in FIGS. 4 and 5.

Each anode 14, is typically a vertical plate of a film-forming metal, such as titanium, and is provided with an electrocatalytically active coating (for example a mixture of a platinum group metal oxide and a film-forming metal oxide, especially a mixture of ruthenium oxide and titanium dioxide). The anode 14 is mounted on a sidewall 15, comprising a plate of titanium, which is in turn conductively bonded to a mild steel plate 16 which serves as a conductor providing a low-resistance electrical flow path between the anodes 14 and copper connectors 17, attached to the mild steel plate 16.

The cathodes 18 which are typically of mild steel or iron mesh, are mounted in a box-like structure 19, typically of mild steel, the cathodes being so ranged as to provide vertically disposed slots 20 in which the anodes are positioned. The cathode box-like structure 19 is further provided with a current-outlet lead 21 attached thereto, an outlet conduit 22 for alkali metal hydroxide solution and an outlet conduit 23 for hydrogen.

The cell is provided with a lid 24 carrying an inlet conduit 25 for alkali metal halide solution and an outlet conduit 26 for halogen. The cell is also provided with a sump 27 for drainage purposes.

Referring to FIG. 5, the diaphragms 6 surround the anodes 14 and are in contact or in close proximity to the surface of the cathodes 18. Each diaphragm 6 is attached to the upper and lower supports 8, 9 by means of strips 4, for example by hot pressing or by application of a suitable cement, as described above. The joining of the diaphragm 6 and the supports 8, 9, is conveniently achieved outside the cell by inserting the diaphragm 6 into an empty cathode box 19, joining the top edges of the diaphragm 6 to the upper support 8, followed by turning the cathode box 19 upside down, and joining the other edge (bottom in the cell) to the lower support 9. The cathode box 19, containing diaphragm 6 and supports 8, 9 is then lowered over the anodes 14 and the cell is assembled.

If the diaphragm 6 contains a removable filler (e.g. starch) this may be removed in situ in the cell by treatment with a mineral acid containing a corrosion inhibitor or by removing electrolytically in situ in the cell (as described in the specification of UK Patent No. 1468355).

The use of the cell according to the invention is illustrated by the following Example:

EXAMPLE

A diaphragm cell of the type shown in FIGS. 4 and 5 was provided with three sets of titanium bladed anode plates 14 (blades 6 mm depth, 4 mm apart) coated with a mixture of ruthenium oxide and titanium dioxide, and mounted on a titanium baseplate 15. The anode plates 14 were fitted into the vertically disposed slots 20 of a cathode box 19 provided with mild steel mesh cathodes 18 (2 mm diameter mesh; 2 mm×2 mm opening). The cell was provided with a continuous sheet 6 of polytetrafluoroethylene which was in contact with the cathodes 18. The diaphragm was fabricated by joining together four "window frame" sheets 1 by hot pressing overlapping strips of a fluorinated ethylene/propylene copolymer fused at or near the edges of the starch-filled polytetrafluoroethylene sheets (2 mm thickness). The diaphragm 6 was in turn attached to the upper and lower supports 9, 10 made of a fluorinated ethylene/-propylene copolymer by hot pressing strips of fluorinated ethylene/propylene (previously fused to the upper and lower edges of the diaphragm) to the said supports. The anode cathode gap was 6 mm. The starch was extracted from the diaphragm electrolytically in situ in the cell at a current density of 2kA/$m^2$ anode surface.

The cell was fed with sodium chloride brine (300 g/liter NaCl) at a rate of 5 liters/hour, and the cell was operated at a current density of 2 kA/$m^2$. The cell operating voltage was 3.2 volts. The chlorine produced contained 97.5% by weight of $Cl_2$ and 2.5% by weight of $O_2$. The sodium hydroxide produced contained 10% by weight of NaOH. The cell operated at a current efficiency of 96%.

What we claim is:

1. An electrolytic diaphragm cell for the production of halogen, hydrogen and an alkali metal hydroxide solution by electrolysis of an aqueous alkali metal halide solution, which cell comprises a plurality of anodes vertically mounted at one side of the cell, a cathode box providing at least the opposite facing side of the cell and providing a cathode between adjacent anodes, a substantially continuous hydraulically permeable diaphragm between adjacent anodes and cathodes, wherein the diaphragm comprises a sheet of a porous non-melt-processable fluorine-containing polymer connected to an upper and lower slotted supports of a melt-processable fluorine-containing polymer by means of strips of a melt-processable fluorine-containing polymer fused to the upper and lower edges of the diaphragm, and wherein the supports are located in the cell so that the slots in the upper and lower supports are in vertical alignment with one another and the anodes extend into the space defined by the upper and lower supports and the diaphragm.

2. A cell as claimed in claim 1 wherein the diaphragm is in the form of a single homogeneous sheet of the non-melt-processable fluorine-containing polymer.

3. A cell as claimed in claim 1 wherein the diaphragm comprises a plurality of sheets of the non-melt processable fluorine-containing polymer which are joined together by joining strips of a melt-processable fluorine-containing polymer fused into said sheets at or near juxtaposed edges of said sheets.

4. A cell as claimed in claim 1 wherein the upper and lower slotted supports are formed with folds along the inside edges of the slots to facilitate connection between the the supports and the strips of melt-processable fluorine-containing polymer fused to the upper and lower edges of the diaphragm.

5. A cell as claimed in claim 4 wherein the diaphragm is joined to the upper and lower slotted supports by means of hot pressing or by the use of a cement comprising a low melting point fluorine-containing polymer.

6. A cell as claimed in claim 1 wherein the non-melt-processable fluorine-containing polymer is polytetrafluoroethylene.

7. A cell as claimed in claim 1 wherein the melt-processable polymer is a fluorinated ethylene/propylene copolymer.

8. An electrolytic diaphragm cell for the production of halogen, hydrogen and an alkali metal hydroxide solution by electrolysis of an aqueous alkali metal halide solution, which cell comprises a plurality of anodes vertically mounted at one side of the cell, a cathode box providing at least the opposite facing side of the cell and providing a cathode between adjacent anodes, a hydraulically permeable diaphragm between adjacent anodes and cathodes, wherein the diaphragm comprises a sheet of porous non-melt-processable fluorine-containing polymer connected to upper and lower supports so that the anodes extend into the space defined by the upper and lower supports and the diaphragm;

said diaphragm comprising a plurality of sheets of the non-melt-processable fluorine-containing polymer which are joined together by joining strips of melt-processable fluorine-containing polymer fused into said sheets at or near juxtaposed edges of said sheets.

* * * * *